US009586249B2

(12) United States Patent
Wolf et al.

(10) Patent No.: US 9,586,249 B2
(45) Date of Patent: Mar. 7, 2017

(54) APPARATUS FOR FEEDING WIRE TO WIRE PROCESSING MACHINES

(75) Inventors: Jürgen Wolf, Walddorfhaeslach (DE); Uwe-Peter Weigmann, Nuertingen (DE); Ralph Steinmaier, Engen (DE); Stefan Jetter, Walddorfhaeslach (DE)

(73) Assignee: Wafios Aktiengesellschaft, Reutlingen (DE)

( * ) Notice: Subject to any disclaimer, the term of this patent is extended or adjusted under 35 U.S.C. 154(b) by 744 days.

(21) Appl. No.: 13/878,175

(22) PCT Filed: Sep. 5, 2011

(86) PCT No.: PCT/EP2011/004466

§ 371 (c)(1),
(2), (4) Date: Jul. 1, 2013

(87) PCT Pub. No.: WO2012/045381

PCT Pub. Date: Apr. 12, 2012

(65) Prior Publication Data

US 2013/0270385 A1 Oct. 17, 2013

(30) Foreign Application Priority Data

Oct. 5, 2010 (DE) ..... 10 2010 047 531

(51) Int. Cl.
*B21C 47/18* (2006.01)
*B21C 47/16* (2006.01)
(Continued)

(52) U.S. Cl.
CPC ..... *B21C 47/18* (2013.01); *B21C 47/16* (2013.01); *B21C 49/00* (2013.01); *B21F 23/00* (2013.01)

(58) Field of Classification Search
CPC ..... B21C 47/18; B21C 47/16; B21C 49/00; B21C 47/003; B21C 47/30; B21F 23/00
(Continued)

(56) References Cited

U.S. PATENT DOCUMENTS 1,504,417 A * 8/1924 Beavers ..... B65H 49/30 242/406
1,653,964 A * 12/1927 Matheson ..... G03B 21/32 242/329.1
(Continued)

FOREIGN PATENT DOCUMENTS

DE 31 20 721 A1 12/1982
DE 32 35 217 A1 3/1984
(Continued)

*Primary Examiner* — Emmanuel M Marcelo
*Assistant Examiner* — Justin Stefanon
(74) *Attorney, Agent, or Firm* — Christensen Fonder Dardi PLLC

(57) ABSTRACT

An apparatus for feeding wire to wire-processing machines, in which the wire is drawn off from a pay-off reel holding a wire coil and rotatable about a spindle and fed to a wire feeder upstream of the wire-processing machine, wherein at least one wire-deflecting device, via which the wire drawn off from the pay-off reel is guided and released towards the wire feeder, is connected downstream of the pay-off reel in the wire draw-off direction, and wherein a wire-storage device is provided upstream of the wire feeder, this apparatus presents a guide path, forming a closed circuit, on which the wire runs and the diameter of which can be altered between a smaller value corresponding to an inner radial position of the guide path and a larger value corresponding to an outer radial position of the guide path, wherein the guide path is spring-pretensioned towards the outer radial position.

8 Claims, 3 Drawing Sheets

(51) Int. Cl.
*B21C 49/00* (2006.01)
*B21F 23/00* (2006.01)

(58) Field of Classification Search
USPC ..... 242/571, 576, 576.1, 577.1, 577.2
See application file for complete search history.

(56) References Cited

U.S. PATENT DOCUMENTS 1,839,321 A * 1/1932 Kent ..... B65H 49/30 242/395
1,908,073 A * 5/1933 Spoor ..... B65H 59/04 242/118.4
2,583,667 A * 1/1952 Pratt ..... A43D 69/04 242/577.1
2,641,420 A * 6/1953 Rumsey ..... B65H 75/14 242/118.4
2,777,646 A * 1/1957 Manahan ..... B65H 75/24 137/355.26
2,797,880 A * 7/1957 Miller ..... B23K 9/1333 242/577
3,302,902 A * 2/1967 Brinkman ..... B21C 47/34 242/576.1
3,319,667 A * 5/1967 Folta ..... B21F 1/00 140/147
3,405,964 A * 10/1968 Tuit ..... B21D 11/07 294/65.5
4,269,369 A * 5/1981 Stroup ..... B65H 59/38 242/420.6
4,381,087 A * 4/1983 Williams ..... B65H 49/30 242/577.3
4,657,202 A * 4/1987 Sauber ..... B65H 75/18 242/577.1
4,774,824 A 10/1988 Ritter et al.
4,899,945 A 2/1990 Jones
5,865,051 A 2/1999 Otzen et al.
6,460,796 B1 * 10/2002 Berning ..... B65H 75/24 137/355.16
6,554,217 B1 * 4/2003 Rodriguez ..... B65H 54/58 242/362
2010/0083721 A1 4/2010 Kern et al.

FOREIGN PATENT DOCUMENTS

DE 34 22 499 A1 12/1985
DE 44 43 503 A1 6/1996
EP 0 255 507 B1 10/1992
EP 1 864 724 A1 12/2007
JP 2004-122204 A 4/2004

* cited by examiner

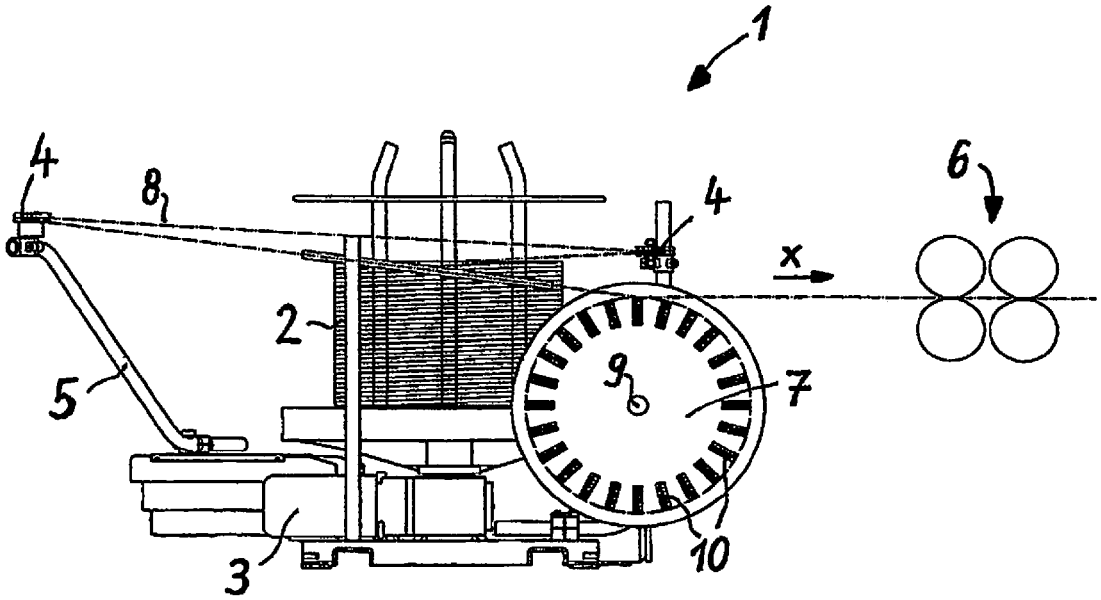
FIG. 1
FIG. 2
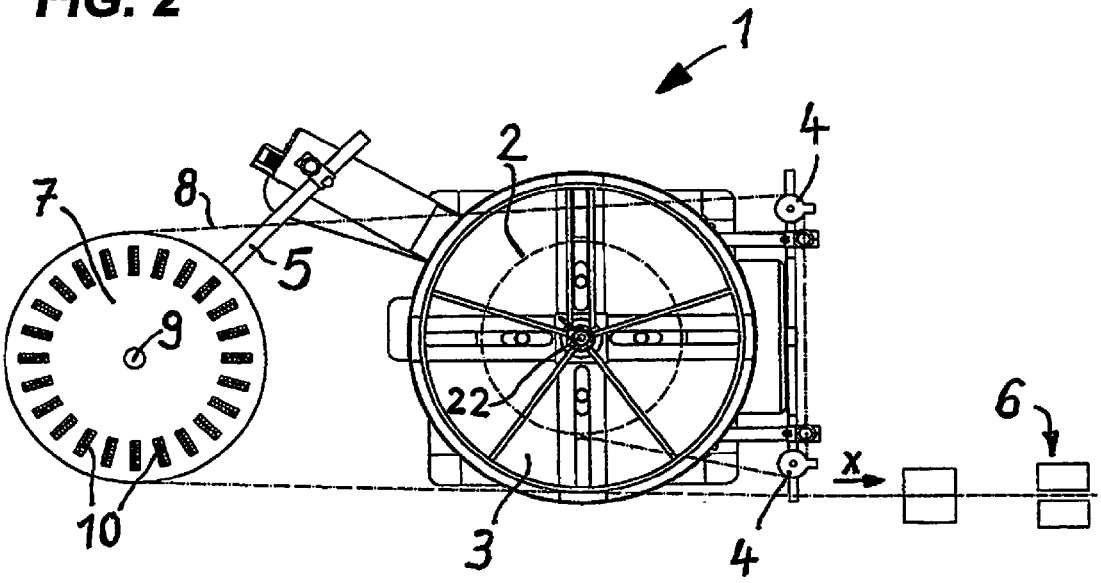

APPARATUS FOR FEEDING WIRE TO WIRE PROCESSING MACHINES

PRIORITY CLAIM

The present application is a National Phase entry of PCT Application No. PCT/EP2011/004466, filed Sep. 5, 2011, which claims priority from German Application Number 10 2010 047 531.9, filed Oct. 5, 2010, the disclosures of which are hereby incorporated by reference herein in their entirety.

FIELD OF THE INVENTION

The invention relates to an apparatus for feeding wire to wire processing machines.

BACKGROUND OF THE INVENTION

The intermittent feeders used in wire-processing machines draw off the wire from a wire coil placed on a pay-off reel, wherein they operate with high accelerations and brake applications. It is desired that the pay-off reel is to run as smoothly as possible, in order that the wire is continuously released. For this, deflecting means and/or swivel arms which are meant to compensate for irregularities in the drawing-off are usually used, as the very large mass of the wire coil for its part cannot be accelerated and decelerated very quickly.

However, the named remedial measures are often insufficient to ensure the desired smooth running of the pay-off reel or to achieve as little as possible to no movement of the swivel arm.

From DE 44 43 503 A1 an apparatus for feeding wire to wire-processing machines is known in which the wire coming from the pay-off reel is guided between the latter and the wire feeder of the downstream wire-processing machine in a loop, wherein the deflection of this loop is detected by a recognition unit. Besides the rotational movement for the unreeling, the pay-off reel can also perform a swivelling movement about the wire-feeding direction, the extent and direction of which is predetermined by the recognition unit. This makes it possible to compensate for the twisting of the wire, which is important in particular during the processing of hard-drawn wire types.

From JP 2004-122204 A a wire feeding is known in which a deflectable deflecting roller is used which is prestressed downwards in spring-loaded manner and functions similarly to a swivel an of a pay-off reel. The deflection of the deflecting roller is detected and the rotational speed of the pay-off reel is regulated accordingly.

In the wire-feeding apparatus, known from EP 0 255 507 B1, of the type named at the beginning, a spring-loaded, deflectable deflecting roller is likewise provided between a straightening rotor and a pay-off reel. In addition, after the straightening rotor, the wire is guided round in a freely running loop, the formation of which is monitored by means of switches. The spring-loaded, deflectable deflecting roller is associated with a sensing means which switches off the wire feeder and the straightening rotor when the length falls below a predetermined minimum value, while switches associated with the loop influence not only the conveying speed of the wire feeder, but also the rotational speed of the straightening rotor in the same direction.

Although these known apparatuses bring certain improvements with regard to a smoother running of the pay-off reels, it has been shown that the pay-off reel (and any swivel arm associated with it) still run far from smoothly in the case of intermittent draw-off movements.

SUMMARY OF THE INVENTION

An apparatus for feeding wire to wire-processing machines in which the wire is drawn off from a pay-off reel that holds a wire coil and rotates about a spindle and fed to a wire feeder upstream of the wire-processing machine, wherein at least one deflecting device downstream of the pay-off reel in the wire draw-off direction is provided via which the wire drawn off from the pay-off reel is guided and released towards the wire feeder, wherein a wire-storage device is provided upstream of the wire feeder that provides smoother running of the pay-off reel.

According to embodiments of the invention a wire-storage device defines a guide path, forming a closed circuit, on which the wire rests and is guided, and the diameter of which can be altered between a minimum value corresponding to an inner radial position of the guide path and a maximum value corresponding to an outer radial position of the guide path. In embodiments the guide path is spring-pretensioned towards adopting the outer radial position.

In embodiments of the invention, between the pay-off reel and the wire-processing machine, an additional wire-storage device which acts as a wire buffer from which the drawing-in movement can be operated, which contributes to a smoother running of the pay-off reel and any swivel arm associated with it. The intermittent draw-off force acts first on this wire-storage device in which, as a result of its guide path that can be altered in its radial position between an inner and an outer radial boundary position, and may be spring-pretensioned running towards the outer radial boundary position, jolts from the feeder of the wire-processing machine can be absorbed in spring-loaded manner and largely compensated for, before they can act with a then, however, significant attenuation (if at all) on the swivel arm of the pay-off reel for compensation there.

A feature and advantage of embodiments of the invention is that it is not necessary to use specific sensing means, such as are used when freely formed loops are employed to detect the current loop sizes in each case. Due to the design of the spring-pretensioning of the guide path, inside the wire-storage device its behaviour can in addition be designed such that the swivelling movement of a swivel arm associated with the pay-off reel is introduced only in the case of a comparatively large spring deflection.

In embodiments of the invention, one of the wire-deflecting devices used is provided in the form of a swivel arm, which is preferably associated with the pay-off reel, spring-pretensioned into a swinging-out direction. Such a swivel arm is combined with the further wire-storage device used according to the invention and they complement each other in such a way that a particularly smooth running of the pay-off reel can be achieved.

The wire-storage device can be attached to any suitable point upstream of the wire feeder in the apparatus according to the invention. However, it has proved particularly advantageous if the wire-storage device for its part is connected directly to the swivel arm or also immediately upstream of the wire feeder.

In embodiments of the invention the wire-storage device is rotatable about a spindle lying perpendicular to the wire-advance direction, aligned perpendicular to the spindle of the pay-off reel.

If in the invention the wire-storage device is attached directly to the pay-off reel, the spindle of the wire-storage device may be aligned approximately parallel to the spindle of the pay-off reel.

In embodiments of the invention, the wire-storage device is formed as a spring wheel, the guide path of which is defined by the radially outer ends of a large number of radially aligned compression springs attached to it. An ultimately uncomplicated structure of the wire-storage device is hereby achieved which can be produced at favourable cost and is extremely effective.

In embodiments of the invention, a spring wheel comprises two side parts, spaced apart from each other, the distance between which is smaller than the diameter of the radially aligned springs, wherein each spring is held in two recesses, arranged radially in both side parts and corresponding to each other in their position, the width of which (seen in the circumferential direction of the spring wheel) is smaller than the diameter of the spring, which is why the latter projects beyond the side parts on both sides. This creates a very simple seat for the radially arranged springs in the spring wheel that is easy to produce and yet extremely effective.

In embodiments of the invention, the wire-storage device is provided directly on a swivel arm associated with the pay-off reel, the wire is deflected, through approximately 180°, on the guide path of the wire-storage device.

In embodiments of the invention, the wire runs through 360° around the guide path of the wire-storage device.

In embodiments of the invention, the defining of the guide path in the wire-storage device with elements other than compression springs can preferably also be achieved by using radially aligned compression elements in the form of fluid-actuated spring elements, wherein in embodiments, the sides of the compression springs facing the circulating wire or the spring elements of the spring wheel are provided with caps made of wear-resistant material or with freely rotatable rollers. The wire-storage device for its part can be attached rotatably here, but can equally also be provided as a fixed, not rotatable device, as the use of wear-resistant caps or freely rotatable rollers on the sides of the compression springs hieing the wire or the spring elements of the spring wheel per se already makes it easily possible for the wire to run along the guide path then formed by these caps or the rotatable rollers in a circumferential movement relative to this.

In embodiments of the invention the guide path in the wire-storage device is formed by a circumferential layer consisting of an elastically compressible material, particularly preferably elastomeric material.

In embodiments of the invention, the compression springs are designed in the form of pistons, running in cylinders, which define the position of the guide path via the free ends of piston rods attached to them. Each piston or piston head and the associated cylinder bottom are formed from a magnetizable, preferably a permanently magnetic, material of identical polarization.

In embodiments of the invention, the wire-storage device comprises a large number of blades, attached around a central holding spindle, running radially outwards from the latter in an arc, freely projecting and consisting of spring-loaded material, which are arranged between two lateral walls (but are not attached to these) and the free end areas of which define the guide path as well as in each case running out into an end section curved in the circumferential direction of the wire. A simply constructed and yet very effective design is also achieved hereby for a wire storage device that can be used in the invention.

In embodiments of the invention, each blade rests, on its side lying in front in the circumferential direction of the wire, against a positioning element the radial position of which is adjustable and thus the length of the end section, running outwards from the latter, of the respective blade can be set. Thus, in a simple way and without large outlay on design, the lever arm of the end section of each blade projecting freely beyond the positioning element and thus also the rigidity of the blade active on the guide path can be set by corresponding adjustment of the positioning elements.

The blades can consist of any suitable and loadable elastic material. However, they are quite particularly preferably designed in the form of spring-steel blades.

DESCRIPTION OF THE FIGURES

The invention is explained in principle in even more detail below by way of example. There are shown in:

FIG. 1 a basic side view of a first embodiment of a wire-feeding apparatus according to the invention with a lateral arrangement of the wire-storage element in the form of a spring wheel;

FIG. 2 the top view of a further embodiment of an apparatus according to the invention in which the wire-storage device is attached directly to a swivel arm in the form of a spring wheel;

DETAILED DESCRIPTION

Figure 3:
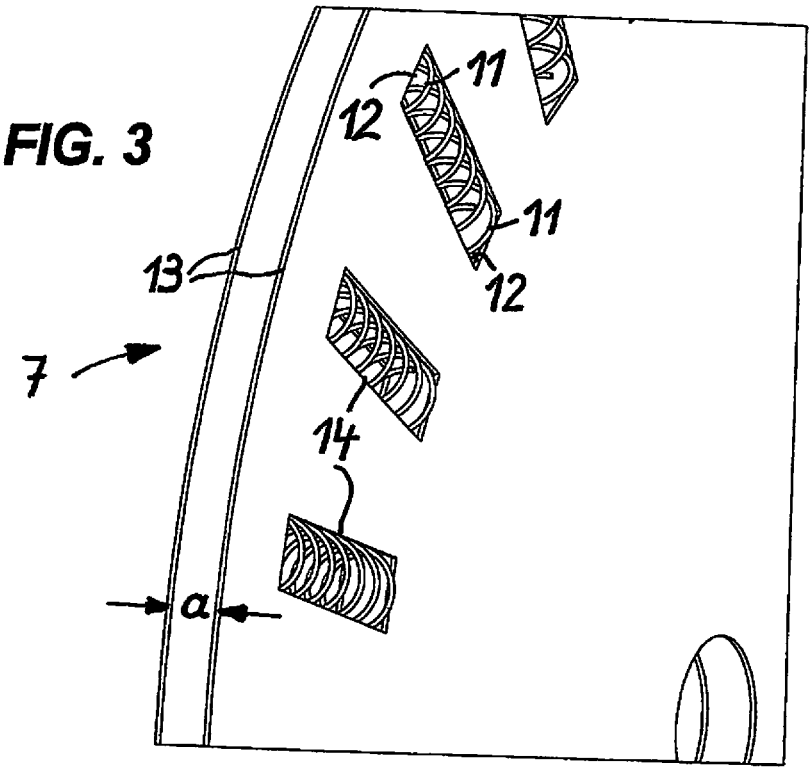
FIG. 3 a perspective representation of a section from a spring wheel of an apparatus according to the invention.

In FIG. 1 a basic side view of an embodiment variant of a wire-feeding apparatus 1 according to the invention is shown, such as can be used in a wire- or pipe-processing machine which works with a material from the coil 2 which rests on a rotatably driven pay-off reel 3 and is drawn off from the latter via deflecting means 4 and a swivel arm 5.

The representation of FIG. 1, between the swivel arm 5 and the processing machine, of which only one feeder 6 is basically indicated here, upstream of this a wire-storage device in the form of a spring wheel 7 is arranged which for its part has a spindle 9 lying horizontal as well as perpendicular to the direction of advance x of the wire 8.

As FIG. 1 shows, the spring wheel 7 contains, distributed over its circumference, a large number of radially arranged and also radially acting spring elements 10, preferably in the form of helical springs. These spring elements 10 may all have an identical shape.

Figure 4:
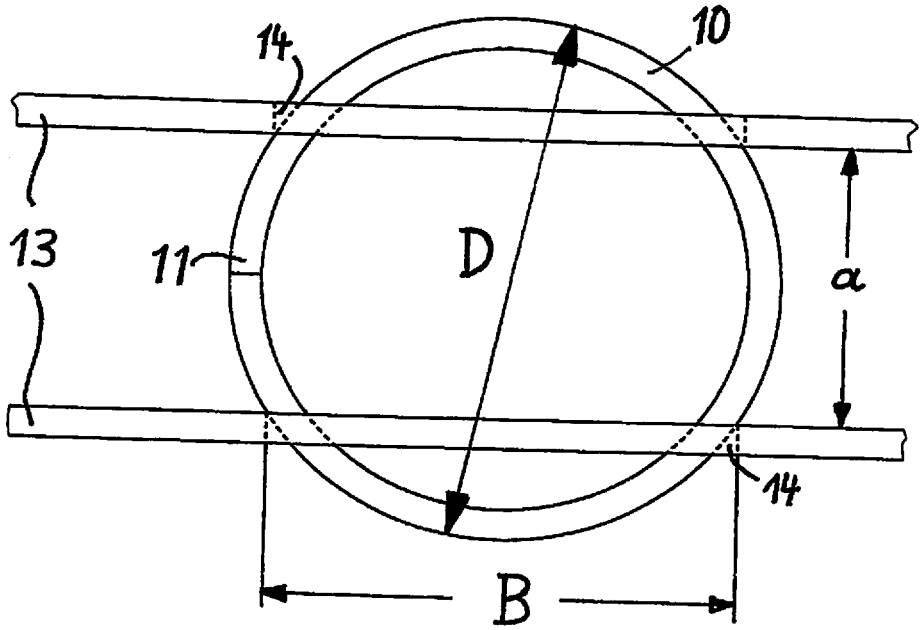
FIG. 4 as purely basic and enlarged representation of the arrangement of a spring element of a spring wheel in an apparatus according to the invention.

In FIGS. 3 and 4, the structure of the spring wheel 7 is shown in detail. This has two circular side parts 13 which act as lateral limiting plates for the wire 8 and are spaced apart from each other by a distance α (seen parallel to the position of the spindle 9). These side parts 13 are preferably produced from sound insulation sheets (of vibration-reducing composite material made of a viscoelastic plastic layer between two steel sheets, e.g. Bondal sheet from Thyssen Krupp Stahl), which is favourable particularly in the case of large diameters.

In these side parts 13 of the spring wheel 7, in radial alignment and uniformly arranged over its circumference, rectangular recesses 14 are provided which act as seats for the spring elements 10 the spring ends 11 of which (cf. FIG. 3), in the assembled state, are bordered by stops 12, which are the radially outer or inner end edges of the recesses 14.

As can be seen from FIG. 4, both the width B of each recess 14 (seen in the circumferential direction of the spring wheel 7) and the distance α between the side parts 13 of the spring wheel 7 are in each case smaller than the diameter D of the spring elements 10 formed as helical springs. This results in the arrangement of the spring elements 10 shown in enlarged detail representation in FIG. 4 with respect to the position of the side parts 13 of the spring wheel 7. As can be seen from FIGS. 3 and 4, the side edges, running approximately radially, of the rectangularly formed recesses 14, seen in the circumferential direction of the spring wheel 7, in each case form a lateral stop for the spring elements 10 which in addition also project outwards laterally beyond the side parts 13.

Figure 5:
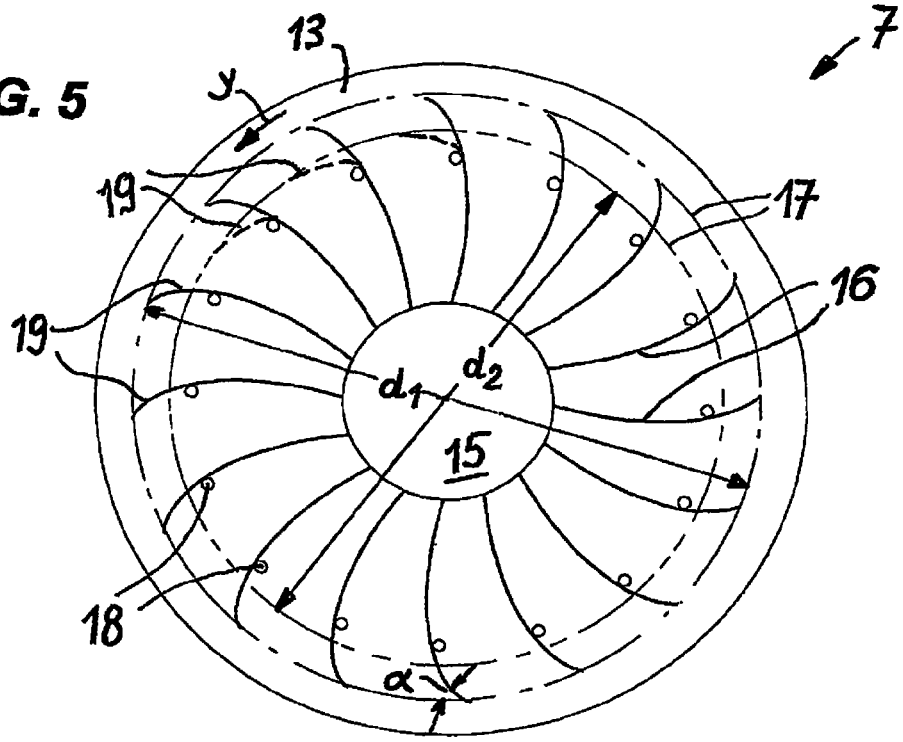
FIG. 5 a purely basic representation of the structure of a wire-storage device according to the invention with curved blades radially projecting from a central holding spindle.
Figure 6:
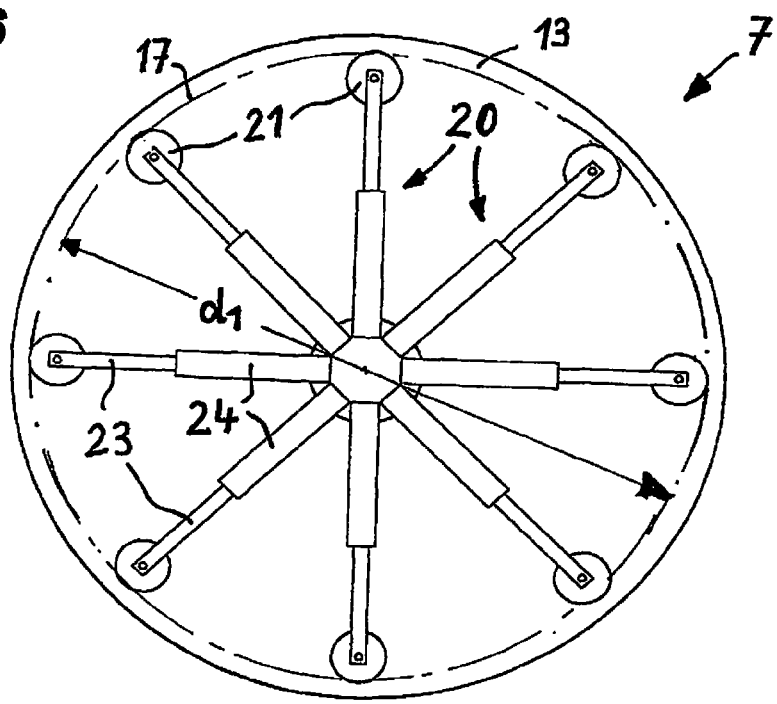
FIG. 6 a likewise purely basic representation of the structure of a wire-storage device according to the invention with fluid-actuated spring elements with freely rotatable rollers at their projecting ends, and FIG. 7 a purely quite basic sectional representation through a spring element in the form of a cylinder with pistons running therein which, like the cylinder bottom, consists of a permanently magnetic material (but of identical polarization).

As FIG. 1 shows furthermore, the wire 8 is deflected, in the wire draw-off direction x behind the swivel arm 5, running through approx. 360° once around the spring wheel 7 and rests on the radially outer ends of the spring elements 10 which, together, define a guide path 17 in the circumferential direction of the spring wheel 7 (this guide path 17 is shown only in FIGS. 5 and 6, but is also present in entirely identical manner in the embodiment of FIGS. 1 to 4).

Along this circumferential guide path 17 defined and predetermined by the radially outer ends 11 of the spring elements 10, the wire 8 arriving at the spring wheel 7 is guided in a circumferential path, as can basically be seen in FIG. 1.

If the feeder 6 of the downstream wire-processing machine is operated and the wire 8 is drawn in by the latter, it presses the spring elements 10 together in radial direction during its circulation around the spring wheel 7 along the position of the guide path 17 initially predetermined by this and tightens the wire loop formed on the spring wheel 7 around the guide path 17. As a result the feeder 6 thus "helps itself" from the supply of wire 8 stored in the spring wheel 7.

During the drawing-in movement of the feeder 6 the spring wheel 7 rotates with it. If the drawing-in movement on the feeder 6 is now intermittent, the wire-storage means of the spring wheel 7 is filled again from the coil 2 when the feeder 6 is at a standstill, as the spring elements 10 are arranged on the spring wheel 7 in such a way that they are always pretensioned in the radially outward direction, thus towards the outermost possible radial position of the guide path 17. During a subsequent drawing-in movement of the feeder 6, the wire 8 is thus again provided very quickly and for the short term in the direction of a wire-storage means to compensate for fluctuations of the drawing-in movement.

FIG. 2 shows a second embodiment of the apparatus 1 in which the wire-storage device in the form of the spring wheel 7 is here arranged directly on the free end of the swivel arm 5 as a deflecting element. The spindle 9 of the spring wheel 7 lies vertical and perpendicular to the wire 8 as well as parallel to the spindle 22 of the pay-off reel 3. In this embodiment, the wire 8 runs around the spring wheel 7, not along the whole extent of the guide path 17, but only over roughly 180°.

In the previously used arrangements of a pay-off reel structure with deflecting means 4 and swivel arm 5, the amount of wire needed in the short term had to be provided via the swivelling movement of the swivel arm 5 pretensioned radially outwards in spring-loaded manner or via the loops of the deflecting means 4. However, this resulted in very large mechanical movements and loads.

The spring elements 10 of the spring wheel 7 or their spring-loaded restoring force acting on the wire 8 and the restoring force of the swivel arm 5 have to be designed in the embodiments shown in the figures such that the swivelling movement of the swivel arm 5 is introduced only in the case of a comparatively large compression travel of the spring elements 10.

In FIGS. 5 and 6, two other embodiments for a spring wheel 7 with other formations of the spring elements 10 are represented, quite basically:

In the embodiment shown in FIG. 5, the spring wheel 7 has a central holding spindle 15, from which, arranged uniformly over its circumference, spring-steel blades 16 freely project in an arc and radially outwards. These blades 16 are arranged between the side parts 13 of the spring wheel 7, but are not secured to these, but only to the holding spindle 15.

The representation of FIG. 5 as well as that of FIG. 6 each show the spring wheel 7 in which the side part 13 lying on top has been removed to represent the position of the spring elements 10.

The spring elements in the form of the blades 16 run curved up to their freely projecting end, as can be seen from FIG. 5. Each blade 16 is supported on its concavely curved side (which is the side that points in the circumferential direction y of the wire 8) on a positioning element 18 in the form of a support pin. The positioning elements 18 are adjustable (not shown in FIG. 5) in their radial position, namely in such a way that in each case they are all adjusted radially at the same time and to the same extent.

The blades 16 are curved at their freely projecting end sections 19 in the circumferential direction y of the wire 8, with the result that the end section 19 of each blade 16 runs at an acute angle α into the guide path 17 defined by the free ends of the blades 16. This applies to all possible diameters of the guide path 17.

If, as a result of the pull on the wire 8 due to the feeder 6, the radial pressure of the wire 8 on the blades 16 predefining and supporting its guide path 17 increases, and these are pressed elastically inwards in their end section 19 still projecting radially outwards from the respective positioning element 18, as is represented, in dashed lines, in FIG. 5 in the case of a few blades 16, the diameter of the guide path 17 which, in the starting state (when the blades 16 are not loaded by the wire), has a maximum value of $d_1$ becomes smaller as a result of the compression of the blade end areas 19 and falls to a value $d_2$, as represented in FIG. 5. If the tension on the wire 8 decreases because for instance the feeder 6 stops, then as a result of the elasticity of the end areas 19 of the blades 16 pressed inwards and the restoring elastic force triggered by this the wire 8 is brought back to a guide path 17 with the diameter $d_1$, wherein wire 8 is correspondingly subsequently fed from the coil 2.

Due to the formation, shown in FIG. 5, of the arched, elastic blades 16, there is a continuous spring-pretension of the blade end areas 19 towards their starting position (in FIG. 5: continuous shape of the blades), i.e. towards the formation of the guide path 17 with a maximum diameter $d_1$.

The radial position of the guide path 17 thus varies depending on the state of tension of the circulating wire, wherein the diameter of the guide path 17 can be altered between a maximum outer radial position (diameter $d_1$) and a minimum inner radial position (diameter $d_2$), wherein as a result of the spring-pretension of the blades 16 (or also other spring elements 10) the free ends of the spring elements 10 defining the guide path 17 are always pretensioned into their maximum outer radial position corresponding to the diameter $d_1$ of the guide path 17. To put it briefly, the radial position of the guide path 17 is pretensioned into its radially outermost position.

In the embodiment of FIG. 6, fluid-actuated spring elements 20 which are provided with freely rotatable rollers 21 at their freely projecting ends are now used as spring-loaded elements. These rollers 21 are attached to small piston rods 23 which run in radially aligned fluid-actuated pressure cylinders 24. Here too, it is provided by a corresponding formation that in the starting position (with piston rods 23 maximally extended, cf. representation of FIG. 6) the fluid pressure acting on the piston rods 23 in the pressure cylinders 24 is equally high in the case of all spring elements 20.

In each pressure cylinder 24 e.g. an air or other gas filling is provided as pressurized fluid which builds up a corresponding spring-loaded counter pressure radially outwards when the associated piston rod 23 is pushed in radially. However, the spring elements 20 could equally also be constructed in such a way that they do not work with the pressure cylinders 24 filled with pressurized fluid, but e.g. pretensioned compression springs are arranged in them.

In the embodiment according to FIG. 6, the guide path 17 is circumferentially defined by the radially outermost points of the rollers 21. The representation of FIG. 6 shows the radially outermost position of the guide path 17 corresponding to the diameter $d_1$ from FIG. 5.

Figure 7:
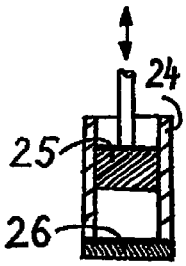

It is also favourable (cf. FIG. 7) to use pistons 25, running in cylinders 24, in which the piston head or the whole piston 25 and the cylinder bottom 20 consist of permanently magnetic material of identical polarization and air is otherwise present in the cylinder 24. Here, as a result of the magnetic repulsive forces occurring between piston 25 and cylinder bottom 26, a maintenance-free and very simply constructed spring element is created which is also very robust and reliable during operation. Naturally, electromagnetizable materials could also be used which, during use, alloy a certain control of the active repulsive forces and thus also of the spring properties through a corresponding influencing of the electrical excitation.

Other embodiments of the spring elements 10 or 16 or 20 are also directly conceivable, provided that these make it possible to alter the diameter of the guide path 17 with simultaneous continuous pretension of same into its radial outermost position.

Instead of the rollers 21 shown in FIG. 6 at the radially outermost ends of the spring elements, caps made of a wear-resistant material (not shown in the figures) could also be attached, over which the wire 8 then runs.

If such caps made of wear-resistant material or freely rotating rollers 21 (FIG. 6) are provided, the spring wheel 7 for its part need not necessarily be arranged rotatable, as the wire 8 can then also simply run along the guide path 17 if the spring elements do not rotate. A rotatability only of the spring elements 16 or 20 inside the spring wheel 7 between (fixed) side parts 13 also represents an effective embodiment of this pressurized storage device.

Also in the embodiment according to FIG. 5, the spring wheel 7 can in principle be arranged non-rotatable and fixed, because the spring elements 16 elastically give way in the direction of travel y of the wire along the guide path 17 and thus a reduction of the diameter of the guide path 17 is also possible without rotation of the side parts 13 of the spring wheel 7 in the case of spring-pretension towards the maximum diameter $d_1$.

The invention claimed is:

1. Apparatus for feeding wire to wire-processing machines, the apparatus comprising:

a rotatable pay-off reel holding a wire coil from which the wire is drawn a wire feeder upstream of the wire-processing machine, the wire fed to the wire feeder from the pay-off reel;

at least one wire-deflecting device positioned intermediate the pay-off reel and the wire feeder for guiding the wire;

a wire-storage device provided in the form of a spring wheel upstream of the wire feeder, said spring wheel defining a circumferential guide path with the wire extending therearound and positioned at a diameter, the diameter of which can be altered between a smaller value corresponding to an inner radial position of the guide path and a larger value corresponding to an outer radial position of the guide path, and being rotatable about a spindle lying perpendicular to a direction of advance of the wire and comprising two circular side parts which act as lateral limiting plates for the wire and being spaced apart from each other by a distance, said side parts defining recesses in radial alignment and uniformly arranged over the circumference of the spring wheel, said recesses receiving a plurality of radially arranged compression springs that define said guide path, said distance between the side parts being smaller than a diameter of each of the compression springs, the diameter of each of the compression springs being defined in a direction parallel to the spindle of the spring wheel, and wherein each compression spring is held in two recesses formed radially in the two side parts.

2. The apparatus of claim 1, wherein the guide path is spring biased towards its outer radial position.

3. The apparatus according to claim 1, further comprising a deflecting device provided in the form of a swivel arm biased into a swinging-out direction.

4. The apparatus according to claim 3, wherein the wire-storage device is provided on the swivel arm.

5. The apparatus according to claim 1, wherein the pay-off reel rotates about a pay-off reel spindle that is perpendicularly positioned with respect to the spindle of the wire-storage device.

6. The apparatus according to claim 1, wherein the spindle of the wheel of the wire-storage device is aligned approximately parallel to a pay-off reel spindle of the pay-off reel.

7. The apparatus according to claim 1, wherein the guide path extends 360° around the wire-storage device.

8. The apparatus according to claim 1, wherein the guide path extends 180° around the wire-storage device.

* * * * *